US005667178A

United States Patent [19]

Yang

[11] Patent Number: 5,667,178

[45] Date of Patent: Sep. 16, 1997

[54] BRACKET ASSEMBLY FOR MOUNTING A SHADE

[76] Inventor: Nelson T. G. Yang, 111-E Corporate Blvd., South Plainfield, N.J. 07080

[21] Appl. No.: 501,545

[22] Filed: Jul. 12, 1995

[51] Int. Cl.[6] ..... A47H 1/10

[52] U.S. Cl. ..... 248/262; 160/902; 248/251; 248/316.6

[58] Field of Search ..... 248/251, 254, 248/257, 262, 264, 265, 267, 268, 269, 316.4, 316.6, 229.12, 229.22, 228.3, 228.5, 231.41, 231.61; 211/105.1; 160/902

[56] References Cited

U.S. PATENT DOCUMENTS

| | | | |
|---|---|---|---|
| 546,507 | 9/1895 | Christmann | 248/251 X |
| 2,181,417 | 11/1939 | Boye | 248/262 X |
| 2,341,048 | 2/1944 | Kopp | 248/231.41 |
| 2,524,711 | 10/1950 | Nelson | 248/264 |
| 2,535,563 | 12/1950 | Boyer et al. | 248/231.41 X |
| 2,698,727 | 1/1955 | Rutledge . | |
| 3,005,615 | 10/1961 | McKay . | |
| 3,790,117 | 2/1974 | Winkler | 248/231.41 X |
| 3,907,240 | 9/1975 | Belli . | |
| 4,120,474 | 10/1978 | Hurley | 248/265 X |

*Primary Examiner*—Leslie A. Braun
*Assistant Examiner*—Derek J. Berger
*Attorney, Agent, or Firm*—Ezra Sutton

[57] ABSTRACT

A mounting bracket assembly is provided for supporting shades, blinds, curtains, cornices, and valances having a support rail, which includes an L-shaped mounting section having an integrally connected back member, interior side members and an extended top member, and the extended top member having a U-shaped channel formed therein for fitting into a U-shaped channel of the support rail. It also includes an L-shaped holding section having an integrally connected rear member, exterior side members, and a bottom support member for supporting the support rail in place. A threaded bolt is provided for connecting an interior lip member of the mounting section with an exterior lip member of the holding section to join the mounting section and the holding section to form the mounting bracket assembly.

17 Claims, 3 Drawing Sheets

BRACKET ASSEMBLY FOR MOUNTING A SHADE

FIELD OF THE INVENTION

This invention relates to a new and improved mounting bracket for supporting shades, valances, cornices, blinds, curtains and the like. More particularly, this mounting shade bracket can be outside mounted on the wall or window molding, or inside mounted into the window frame or molding.

BACKGROUND OF THE INVENTION

Mounting brackets of various designs have been used to support shades, blinds, curtains, valances, cornices and the like. These brackets are mounted or fastened to a wall, or to a window frame, in a number of various positions depending upon the structure of the mounting bracket and/or hanging element, ie. curtain. Conventional designs for mounting brackets include channel-type, metal headrails; box-like metal structures having a plurality of slide plates therein; U-shaped metal structures having a screw clamp; an L-shaped metal flange having a snap holder; an inverted L-shaped metal stamping having horizontal and vertical wings; and inverted L-shaped metal flange having a slide plate holder.

However, these prior art mounting brackets have various drawbacks and have not been completely satisfactory. For example, they do not securely hold the shades or blinds to prevent them from being pulled out of the mounting bracket during use.

It would be highly desirable to provide a mounting bracket which is adjustable, and easily mounted for simple installation. A bracket assembly when installed should hold the shade firmly locked in place to avoid the shade being snapped out when pulled on by the user.

DESCRIPTION OF THE PRIOR ART

Mounting brackets for blinds and shades have been generally disclosed in the prior art. U.S. Pat. No. 2,698,727 discloses a mounting bracket for Venetian blinds. The mounting bracket screws to the underside of a window sill or frame. The bracket design is a channel-type, metal headrail having front, bottom and rear walls that snap into an L-shaped mounting frame which has a side-latching member for holding the metal headrail in place when mounted to the window frame.

U.S. Pat. No. 3,005,615 discloses a bracket assembly to support a curtain rod, a venetian blind, a valance and/or a cornice. The bracket comprises a box-like metal structure having one side wall and one end open. A secondary plate slides into the bracket structure and both parts have a plurality of aligning slots. The rod support element which is a small box-like metal structure is used as a further support. The support element can be mounted to both the secondary plate and bracket, or mounted to a tertiary element only.

U.S. Pat. No. 3,907,240 discloses a multipurpose shade, blind and curtain support system. The right and left window brackets use a detachable U-shaped member along with a connecting member to secure the edge of a window stop using a clamp screw, without the need of screws to fasten the bracket to the window frame and/or sill.

The prior art patents do not disclose a designer shade mounting bracket which is easily adjustable and easily mounted by screws, and which has only two elements for simple installation and mounting of the designer shade to the wall, window frame and/or sill. Also, the prior art patents do not disclose a bracket assembly that holds the shade firmly and securely locked in place to avoid the shade being snapped out of the mounting assembly when pulled on by the user.

Accordingly, it is an object of the present invention to provide a designer shade mounting bracket assembly which is easily adjustable; is easily and quickly installed to a wall, window frame or sill using only two mounting screws and a screwdriver; and is inexpensive.

Another object of the present invention is to provide a designer shade mounting bracket assembly which includes only two elements for simple installation and mounting of the designer shade to a wall, window frame, or window sill without causing any substantial damage or marring of the window frame or wall.

Another object of the present invention is to provide a designer shade mounting bracket assembly which holds the designer shade firmly and securely locked in place to avoid the shade being snapped out of the mounting brackets, when pulled on by the user Another object of the present invention is to provide a designer shade mounting bracket assembly, which in the installed configuration is barely visible, and does not interfere with the decor and color of the room.

A further object of the present invention is to provide a designer shade mounting bracket installation kit having simple installation instructions and a minimal number of steps.

A still further object of the present invention is to provide a designer shade mounting bracket assembly that can be mass produced in an automated and economical manner, and which is affordable by the consumer.

SUMMARY OF THE INVENTION

In accordance with the present invention, there is provided an improved designer shade mounting bracket assembly having a mounting section and a holding section. The mounting bracket may be made out of stamped metal, such as aluminum or stainless steel; or may be molded out of a heavy-duty plastic material.

The mounting section has an L-shaped configuration having a back member, interior sidewalls and an extended top member having a U-shaped channel formed therein. The back wall and top member have mounting openings for securing the mounting section to a wall, window frame or window sill. The U-shaped channel is used for locking the shade in place which has a corresponding U-shaped channel.

The holding section also has a mating L-shaped configuration having a back member, exterior sidewalls and a bottom holding member for securing the rail for the shade firmly in place.

Both the mounting section and holding section of the mounting bracket assembly have correspondingly aligned lip members each having openings for connecting the aforementioned sections together by a connecting bolt or the like which forms the mounting bracket assembly.

The mounting bracket assembly is easily mounted and secured to a wall, window frame, molding or sill by the use of two or more bracket screws. The mounting bracket assembly is in a kit form, where there are a plurality of mounting bracket assemblies and a number of bracket holding screws for mounting shades, blinds, curtains and the like at the appropriate place around a window.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED EMBODIMENT

Figure 1:
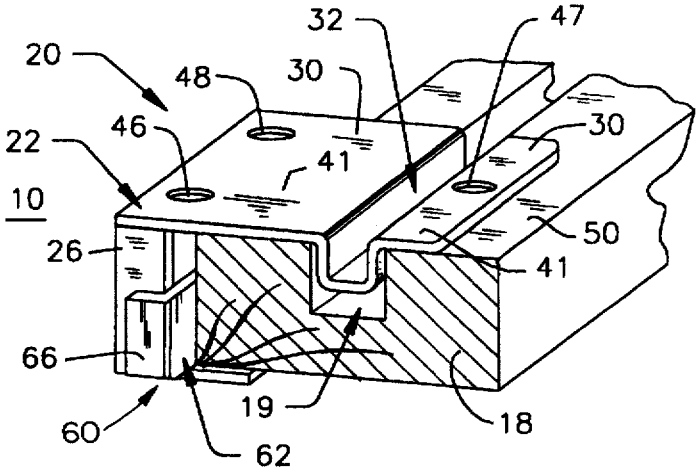
FIG. 1 is a side perspective view of the designer shade mounting bracket assembly of the present invention showing it secured to the wood rail of a shade and holding it in place.

The designer shade mounting bracket assembly 10 is shown in detail in FIGS. 1 through 6. The mounting bracket 10, as shown in FIGS. 1,2,3, and 4, is formed in two sections which are a mounting section 20 and a holding section 60. The mounting section 20 and holding section 60 are formed from stamping a flat piece of sheet metal into the desired form having substantial rigidity and durability, using metals like aluminum or stainless steel. Alternatively, mounting bracket assembly sections 20 and 60 may be molded to the desired shape by using a heavy-duty plastic having substantial rigidity.

Figure 2:
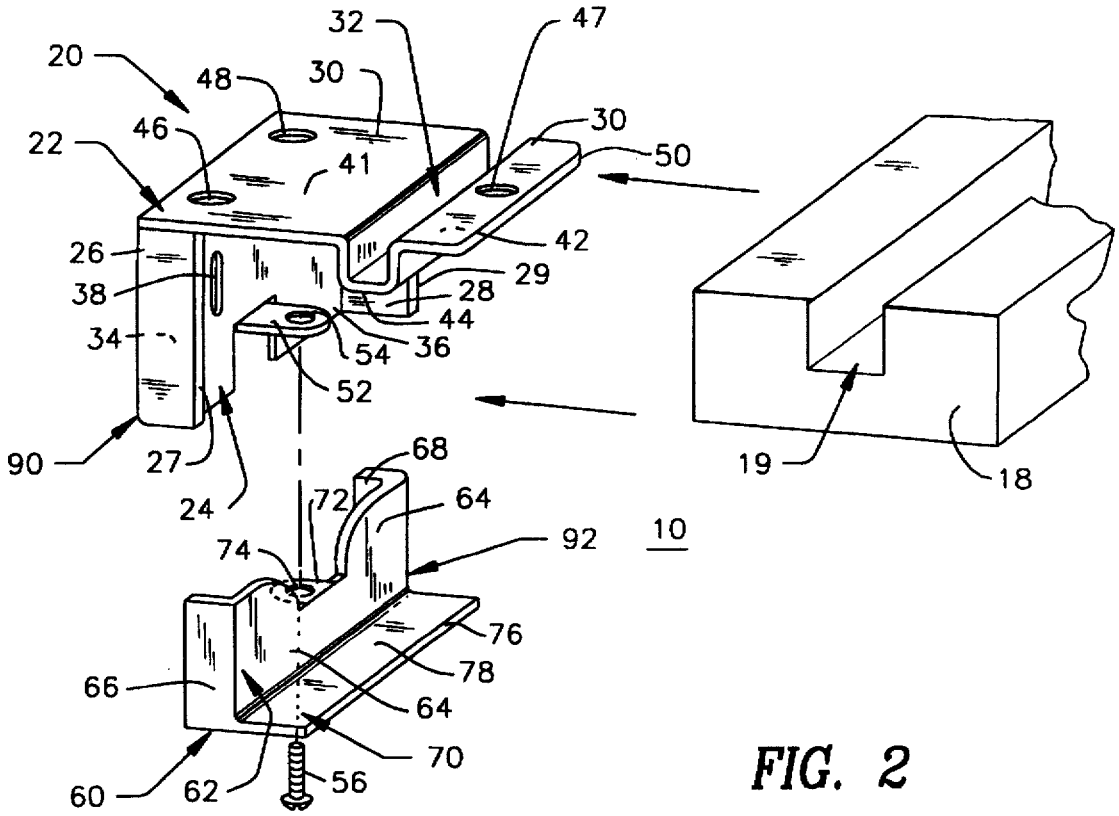
FIG. 2 is an exploded side perspective view of the designer shade mounting bracket assembly showing its two component elements.
Figure 3:
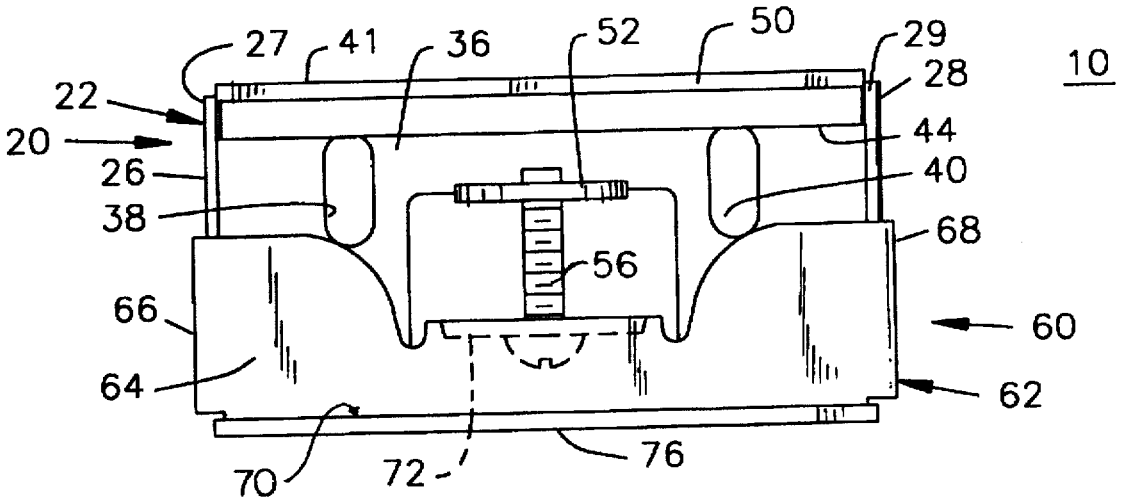
FIG. 3 is a front elevational view of the mounting bracket assembly showing the mounting section and the holding section connected by a threaded bolt.
Figure 4:
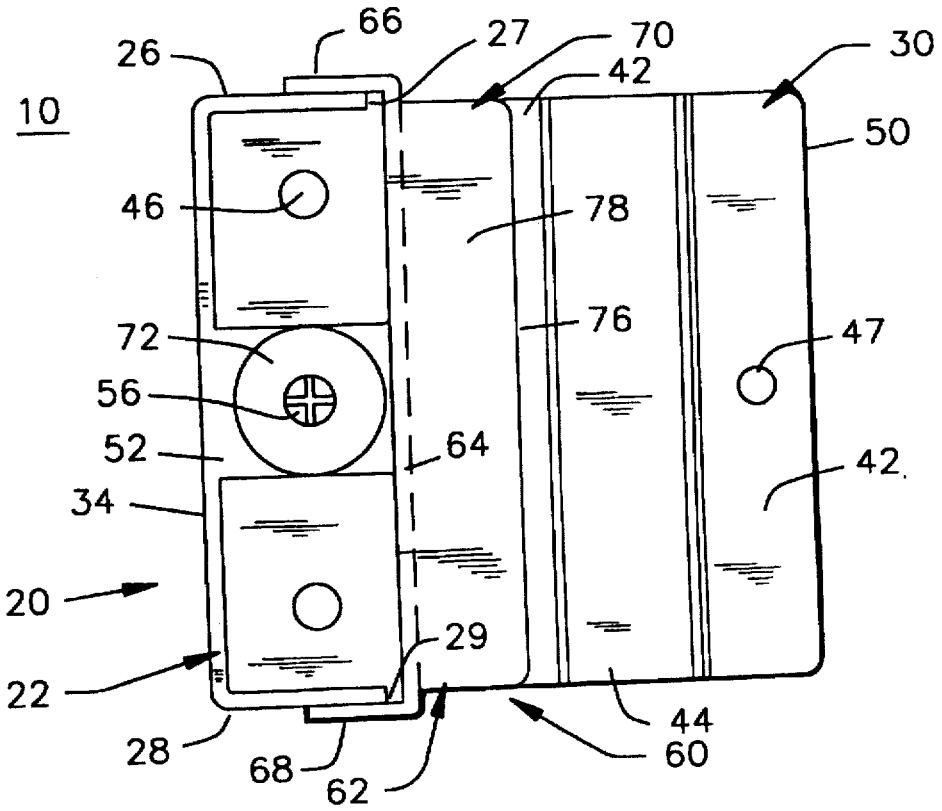
FIG. 4 is a bottom plan view of the mounting bracket assembly showing the mounting section connected to the holding section.

The mounting section 20 of bracket assembly 10 has an L-shaped, box-like configuration 22, as depicted in detail by FIGS. 2,3, and 4, and includes an integrally connected back member 24, left and right interior side wall members 26 and 28, and an extended top member 30 having an integral U-shaped channel 32 stamped therein. Located on the back wall member 24 there are a pair of spaced-apart left and right mounting slot openings 38 and 40. These slot openings 38 and 40 are used for affixing mounting section 20 to a wall area 12 via mounting screws 58 which are inserted in slot openings 38 and 40 and screwed tightly to the wall are 12. Also, included on back wall member 24 is an integrally attached interior semi-oval, lip member 52 having a threaded circular opening 54 for the connecting of the two sections 20 and 60 together using threaded connecting bolt 56. Lip member 52 is disposed extending inwardly at a 90° angle from the back wall member 24 of mounting section 20.

Figure 5:
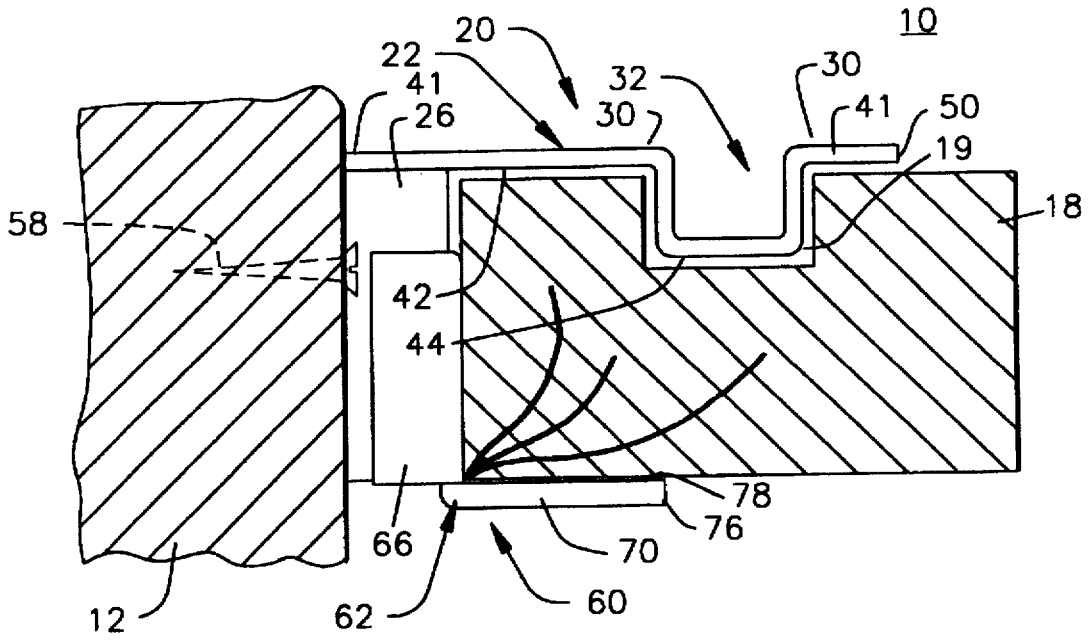
FIG. 5 is a side elevational view of the mounting bracket assembly showing an outside mounting by screws into a wall.
Figure 6:
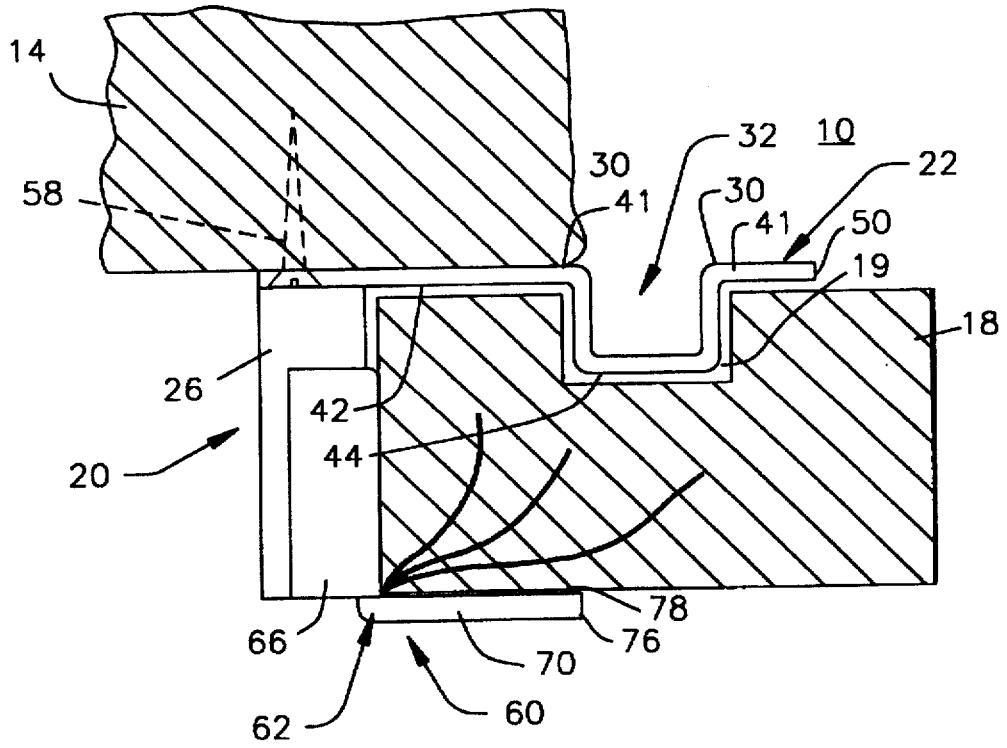
FIG. 6 is a side elevational view of the mounting bracket assembly showing an inside mounting by screws into a window frame.

Located on the extended top member 30 and adjacent to the interior side wall members 26 and 28, there are a plurality of spaced-apart left, right and center circular mounting openings 46, 47, and 48, as shown in FIG. 2 of the drawings. These circular openings 46, 47, and 48 are used for affixing mounting section 20 to a window frame 14 or window sill 16, using mounting screws 58 which are inserted into openings 46, 47, and 48 and screws 58 are then screwed tightly into the window frame 14 or window sill at a properly located position according to mounting instructions. Also, included on the extended top member 30 is the U-shaped channel 32 which is aligned with U-shaped channel 19 of wood rail 18 when mounting bracket 10 is in its assembled state, as shown in FIGS. 1, 5, and 6.

The holding section 60 of bracket assembly 10 is formed in an L-shaped configuration 62, as depicted in detail by FIGS. 2 and 3, and includes an integrally attached rear wall member 64, left and right exterior side wall members 66 and 68, and a bottom support member 70. Included on the rear wall member 64 there is an integrally attached exterior semi-oval, lip member 72 having a threaded circular opening 74 for connecting together sections 20 and 60 with threaded connecting bolt 56. Lip member 72 is disposed extending outwardly at a 90° angle from the rear wall member 64 of holding section 60.

The back member 24 and the interior side members 26 and 28 form a first U-shaped member 90, and the rear member 64 and the exterior side members 66 and 68 form a second U-shaped member 92, wherein first and second U-shaped members 90 and 92 interfit with each other during assembly, and wherein interior and exterior side members 26 and 66 are coextensive with each other, and wherein interior and exterior side members 28 and 68 are coextensive with each other. Further, the front edges 27 and 29 of interior side walls 26 and 28 are adjacent to the rear surface 80 of rear member 64, as shown in FIG. 2. This configuration aligns interior lip member 52 of mounting section 20 with exterior lip member 72 of holding section 60, such that the connecting bolt 56 joins both sections 20 and 60 together, as depicted in FIGS. 1, 3, and 4 of the drawings.

The mounting section 20 and holding section 60 are formed from a piece of sheet metal having a thickness of 1 mm±0.1 mm. The mounting section 20 in its stamped and formed state has an L-shaped configuration having overall measurements, where the back member 24 measures 38 mm in width by 23 mm in height; the interior side members 26, 28 measure 9 mm in width by 23 mm in height; and the extended top member 30 with the integral U-channel 32 formed therein measures 38 mm in width by 38 mm in length. The U-shaped channel 32 measures 38 mm in width by 5 mm in depth by 6 mm along length 44. The mounting circular openings 46, 47, and 48 on top member 30 measure 4 mm in diameter. The mounting slot openings 38, 40 on back member 24 measure 4 mm in width by 7 mm in length.

The holding section 60 in its stamped and formed state also has L-shaped configuration having overall measurements, where rear member 64 measures 42 mm in width by 15 mm in height; the exterior side members 66, 68 measure 5 mm in width by 15 mm in height; and support member 70 measures 35 mm in width by 11 mm in length.

Both the interior and exterior semi-oval lip members 52 and 72 for connecting the mounting and holding sections 20 and 60 together, have measurements that are 10 mm in width by 10 mm in length. All linear tolerances for the mounting bracket 10 measure ±0.5 mm, and diameter tolerances measure ±0.1 mm.

OPERATION OF THE PRESENT INVENTION

When installing a designer shade for a window, the mounting bracket assembly is provided in 10 an installation kit which may be used in several different ways for mounting the shade in a window area. The installation kit includes a plurality of mounting bracket assemblies 10 (typically three), a number of large bracket screws 58, a cord cleat (not shown in Figures), and a pair of small cord cleat screws. The only tools needed by the installer are a pencil, a phillips-head screw driver, and an awl or drill.

The installer places the two or three mounting bracket assemblies 10 on the shade temporarily and then holds the shade level at the desired height and centers the shade over the window. The installer then marks with a pencil the exact location of each bracket 10 including the center bracket 10 if applicable. The installer then removes the shade from the mounting brackets 10 to work with the brackets 10 only.

For an outside mounting, as depicted in FIG. 4, the installer then takes each bracket assembly 10 and places it at the previously marked location, such that the rear surface 34 of back member 24 is flush with the wall area 12 or window molding 14. The installer then marks with a pencil the exact position of slot openings 38 and 40, and drills or awls a small starter hole for receiving mounting screws 58. The installer then places each mounting screw 58 into slot openings 38 and 40 from the front surface 36 of back wall member 24 and into the starter holes in the wall area 12 or window molding 14. The installer then screws the back member 24 of bracket 10 tightly into the wall 12 or window molding 14 with the two large screws 58, using the phillips-head screw driver. These aforementioned steps are repeated for each of the other brackets 10 installed on the wall 12 or window molding 14, such that a small or large shade my be installed.

For an inside mounting, as depicted in FIG. 5, the installer takes each bracket assembly 10 and places it at the previously marked position within the window frame 14 or window sill 16. The installer then places the top surface 41 of the extended top member 30 in a flush position against the exact marked position of bracket mounting section 20 on the window frame 14 or sill 16, and the installer then marks with a pencil the exact position of circular openings 46, 47, and 48. The installer then drills or awls a small starter hole opening for the mounting screws 58. The installer then places each mounting screw 58 into the circular openings 46, 47, and 48 from the bottom surface 42 of top member 30 and into the starter holes in the window frame 14 or sill 16. The installer then screws tightly the three mounting screws 58, using the phillips-head screw driver, such that the extended top member 30 is secured and is flush against the window frame 14 or window sill 16. These aforementioned steps are repeated for each of the other mounting brackets 10 installed on the window frame 14 or sill 16, such that a small or large shade may be installed.

In both cases of inside and outside mountings as depicted in FIGS. 5 and 6, the holding section 60 is connected to the mounting section 20 by inserting bolt 56 through aligned holes 74 and 54 and only partially threading it, to make a loose connection of the assembly 10 so as to leave sufficient space for receiving wood rail 18.

Once the bracket assemblies 10 are attached to their proper locations on a wall 12, window frame 14 or window sill 16, the installer aligns the wood rail 18 (which is at the top of the shade) with U-shaped channel 32, such that the bottom surfaces 42 and 44 of top member 30 and the U-shaped channel 32 are aligned and flush with the U-shaped channel 19 of wood rail 18, and then snaps them in place. The installer then tightens the previously threaded bolt 56, such that the contacting surface 78 of holding member 70 is secured tightly and is locked and flush against the bottom surface of wood rail 18.

When the bracket assemblies 10 are installed, they are essentially hidden from view, as the user only sees the front edges 50 and 72 of the assembled brackets 10, where edges 50 and 72 are between the wood rail 18 and the molding 14 of the window above it.

The bracket assemblies are now securely locked against the bottom of the shade's wood rail 18. Thus, the aforementioned wood rail 18 cannot be easily snapped out when pulled on by the user during operation of the designer shade, as depicted in FIGS. 1, 5, and 6 of the drawings.

ADVANTAGES OF THE PRESENT INVENTION

Accordingly, an advantage of the present invention is that it provides a designer shade mounting bracket assembly which is easily adjustable; is easily and quickly installed to a wall, window frame or sill using only two mounting screws and a screwdriver; and is inexpensive.

Another advantage of the present invention is that it provides for a designer shade mounting bracket assembly which includes only two elements for simple installation and mounting of the designer shade to a wall, window frame, or window sill without causing any substantial damage marring of the window frame or wall.

Another advantage of the present invention is that it provides for a designer shade mounting bracket assembly which holds the designer shade firmly and securely locked in place to avoid the shade being snapped out of the mounting brackets, when pulled on by the user.

Another advantage of the present invention is that it provides for a designer shade mounting bracket assembly, which in the installed configuration is barely visible, and does not interfere with the decor and color of the room.

A further advantage of the present invention is that it provides for a designer shade mounting bracket installation having simple installation instructions and a minimal number of steps.

A still further advantage of the present invention is that it provides for a designer shade mounting bracket assembly that can be mass produced in an automated and economical manner, and which is affordable by the consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A mounting bracket assembly for supporting shades, blinds, curtains, cornices and valances having a support rail, comprising:

a) an L-shaped mounting section having an integrally connected back member, interior side members and an extended top member, and said extended top member having a U-shaped channel formed therein for fitting into a U-shaped channel of the support rail;

b) an interior lip member having a hole and being integrally connected to said back member and formed at a 90° angle thereto;

c) an L-shaped holding section having an integrally connected rear member, exterior side members, and a bottom support member for supporting said support rail in place;

d) an exterior lip member having a hole and being integrally connected to said rear member and formed at a 90° angle thereto for alignment with said interior lip member;

e) connecting means for connecting said interior lip member of said mounting section with said exterior lip member of said holding section to join said mounting section and said holding section to form said mounting bracket assembly;

f) first mounting means for attaching said back member of said mounting section to a wall or window molding and for receipt of an attachment means into said first mounting means; and g) second mounting means for attaching said top member of said mounting section to a window-frame or window sill and for receipt of said attachment means into said second mounting means.

2. A mounting bracket assembly in accordance with claim 1, wherein said back member and said interior side members form a first U-shaped member, and wherein said rear member and said exterior side members form a second U-shaped member, and wherein said first and second U-shaped members interfit with each other during assembly, and wherein each of said interior and exterior side members are coextensive with each other.

3. A mounting bracket assembly in accordance with claim 1, wherein each of said interior side members is connected to the opposite ends of said back member at a 90° angle.

4. A mounting bracket assembly in accordance with claim 1, wherein said top member is connected to said back member at a 90° angle.

5. A mounting bracket assembly in accordance with claim 1, wherein said interior lip member extends from said back member in the same direction as said top member.

6. A mounting bracket assembly in accordance with claim 1, wherein said hole of said interior lip member is threaded.

7. A mounting bracket assembly in accordance with claim 1, wherein each of said exterior side members is connected to the opposite ends of said rear member at a 90° angle.

8. A mounting bracket assembly in accordance with claim 1, wherein said bottom support member is connected to said rear member at a 90° angle.

9. A mounting bracket assembly in accordance with claim 1, wherein said bottom support member is generally flat and in a substantially rectangular configuration.

10. A mounting bracket assembly in accordance with claim 1, wherein said exterior lip member extends from said rear member in the opposite direction of said exterior side members.

11. A mounting bracket assembly in accordance with claim 1, wherein said hole of said exterior lip member is threaded.

12. A mounting bracket assembly in accordance with claim 1, wherein said bracket assembly is made from sheet metal formed of aluminum, steel, or stainless steel.

13. A mounting bracket assembly in accordance with claim 1, wherein said bracket assembly is made form a molded, heavy-duty, plastic material.

14. A mounting bracket assembly in accordance with claim 1, wherein said connecting means is a metal or plastic element.

15. A mounting bracket assembly in accordance with claim 1, wherein said attachment means are screws, nails, or staples.

16. A mounting bracket assembly in accordance with claim 1, wherein said first mounting means are in the form of a plurality of openings in said back member.

17. A mounting bracket assembly in accordance with claim 1, wherein said second mounting means are in the form of a plurality of openings in said top member.

* * * * *